US006564476B1

(12) United States Patent
Hernandez

(10) Patent No.: US 6,564,476 B1
(45) Date of Patent: May 20, 2003

(54) FLEX SOLE

(75) Inventor: Homar Hernandez, Boca Raton, FL (US)

(73) Assignee: BBC International, Ltd., Boca Raton, FL (US)

( * ) Notice: Subject to any disclaimer, the term of this patent is extended or adjusted under 35 U.S.C. 154(b) by 0 days.

(21) Appl. No.: 09/496,922

(22) Filed: Feb. 2, 2000

Related U.S. Application Data

(63) Continuation-in-part of application No. 09/347,051, filed on Jul. 2, 1999, now Pat. No. 6,408,544.

(51) Int. Cl.[7] ..... A43B 13/18

(52) U.S. Cl. ..... 36/28; 36/103; 36/30 R; 36/32 R

(58) Field of Search ..... 36/103, 28, 30 R, 36/32 R, 35 R, 29

(56) References Cited

U.S. PATENT DOCUMENTS

| | | | | |
|---|---|---|---|---|
| 1,781,715 | A | | 11/1930 | Blakely |
| 1,994,681 | A | | 3/1935 | Blumenfeld |
| 2,101,761 | A | | 12/1937 | Stagl |
| 2,502,774 | A | | 4/1950 | Alianiello |
| 2,640,283 | A | | 6/1953 | McCord |
| 2,826,832 | A | | 3/1958 | Rollman et al. |
| 2,833,057 | A | | 5/1958 | Hack |
| 2,981,011 | A | | 4/1961 | Lombardo |
| 3,042,948 | A | | 7/1962 | Di Nunzio |
| 3,087,262 | A | | 4/1963 | Russell |
| 3,166,609 | A | | 1/1965 | Wilder |
| 3,662,415 | A | * | 5/1972 | Doane |
| 4,124,946 | A | | 11/1978 | Tomlin |
| 4,133,118 | A | | 1/1979 | Khalsa et al. |
| 4,245,406 | A | | 1/1981 | Landay et al. |
| 4,247,513 | A | | 1/1981 | Liu |
| 4,316,332 | A | | 2/1982 | Giese et al. |
| 4,316,335 | A | | 2/1982 | Giese et al. |
| 4,364,188 | A | | 12/1982 | Turner et al. |
| 4,364,189 | A | | 12/1982 | Bates |
| 4,366,630 | A | | 1/1983 | Bloom |
| RE31,173 | E | | 3/1983 | Daswick ..... 36/30 |
| 4,377,041 | A | | 3/1983 | Alchermes |
| 4,378,642 | A | | 4/1983 | Light et al. |
| 4,399,620 | A | | 8/1983 | Funck |
| 4,418,483 | A | | 12/1983 | Fujita et al. |
| 4,463,505 | A | | 8/1984 | Duclos |
| 4,502,234 | A | | 3/1985 | Schaefer et al. |
| 4,507,879 | A | | 4/1985 | Dassler |
| 4,542,598 | A | | 9/1985 | Misevich et al. ..... 36/114 |
| 4,546,556 | A | | 10/1985 | Stubblefield |
| 4,547,979 | A | | 10/1985 | Harada et al. |
| 4,624,061 | A | | 11/1986 | Wezel et al. |
| 4,663,865 | A | | 5/1987 | Telecemian |
| 4,667,423 | A | | 5/1987 | Autry et al. |
| 4,672,754 | A | | 6/1987 | Ehrlich |
| 4,674,204 | A | | 6/1987 | Sullivan et al. |

(List continued on next page.)

FOREIGN PATENT DOCUMENTS

| | | |
|---|---|---|
| EP | 0 278 031 A1 | 8/1988 |
| EP | 0 408 793 A1 | 1/1991 |
| WO | PCT/US99/24026 | 10/1999 |

*Primary Examiner*—Ted Kavanaugh
(74) *Attorney, Agent, or Firm*—Darby & Darby

(57) ABSTRACT

The invention advantageously provides enhanced support of the foot wearing a shoe according to the invention, while eliminating unnecessary manufacturing steps. According to the invention, an upper, an insole, and an outsole are provided to manufacture a shoe. The outsole comprises a heel, an arch, and a plantar region. A cavity is formed in one or more of the heel, arch and plantar regions of the outsole. A cushioning pad is permanently affixed in the cavity. The upper, insole and outsole are then assembled to make the shoe according to the invention. The pad functions integrally with the outsole in cushioning shock to a given area of the foot wearing the shoe. A midsole and the manufacturing process for making the same are no longer needed as a result.

6 Claims, 10 Drawing Sheets

U.S. PATENT DOCUMENTS 4,676,010 A 6/1987 Cheskin
4,694,591 A 9/1987 Banich et al.
4,706,316 A 11/1987 Tanzi
4,730,402 A 3/1988 Norton et al.
4,759,136 A 7/1988 Stewart et al.
4,768,295 A 9/1988 Ito ..... 36/28
4,783,910 A 11/1988 Boys, II et al.
4,794,707 A 1/1989 Franklin et al.
4,798,010 A 1/1989 Sugiyama
4,815,221 A 3/1989 Diaz
4,823,483 A 4/1989 Chapnick
4,843,735 A 7/1989 Nakanishi
RE33,066 E 9/1989 Stubblefield
4,876,053 A 10/1989 Norton et al.
4,897,936 A 2/1990 Fuerst
4,910,886 A 3/1990 Sullivan et al.
4,918,838 A 4/1990 Chang ..... 36/28
5,025,573 A 6/1991 Giese et al.
5,077,915 A 1/1992 Gross
5,086,574 A 2/1992 Bacchiocchi
5,092,060 A 3/1992 Frachey et al.
5,147,589 A 9/1992 Chang et al.
5,177,824 A 1/1993 Ou
5,235,715 A 8/1993 Donzis ..... 12/142 R
5,255,451 A 10/1993 Tong et al.
5,311,674 A 5/1994 Santiyanont et al.
5,319,866 A 6/1994 Foley et al. ..... 36/91
5,362,435 A 11/1994 Volpe
5,369,896 A 12/1994 Frachey et al.
5,467,536 A 11/1995 Ramer et al.
5,469,639 A 11/1995 Sessa
5,554,694 A 9/1996 Crow
5,575,089 A 11/1996 Giese et al.
5,667,738 A 9/1997 Krajcir
5,695,850 A 12/1997 Crow
5,718,063 A 2/1998 Yamashita et al.
5,768,806 A 6/1998 Parisotto
5,806,209 A 9/1998 Crowley et al. ..... 36/28
5,815,949 A 10/1998 Sessa
5,839,208 A 11/1998 Huang
5,862,614 A 1/1999 Koh
5,881,478 A 3/1999 McMahon et al.
5,896,608 A 4/1999 Whatley
5,906,872 A 5/1999 Lyden et al.
5,926,974 A 7/1999 Friton
5,926,975 A 7/1999 Goodman et al.
5,933,982 A 8/1999 Chen
5,946,755 A 9/1999 Aoki
5,964,046 A 10/1999 Brooks
5,983,529 A 11/1999 Serna
6,055,746 A 5/2000 Lyden et al. ..... 36/29
6,367,172 B2 * 4/2002 Hernandez ..... 36/103

* cited by examiner

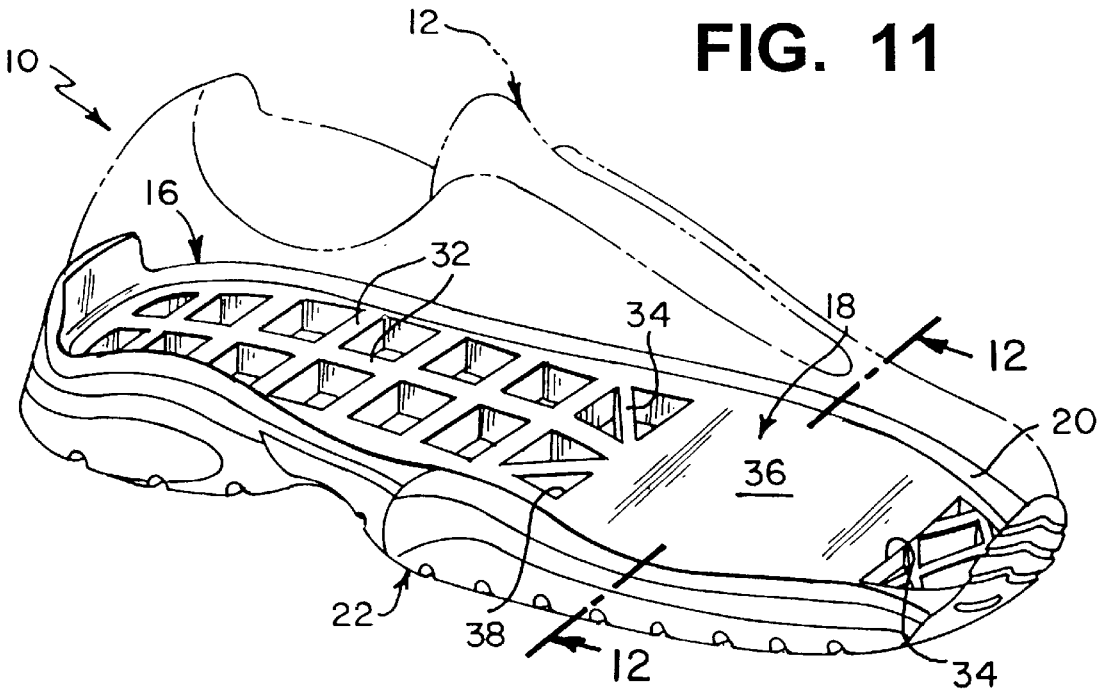
FIG. 11
FIG. 12
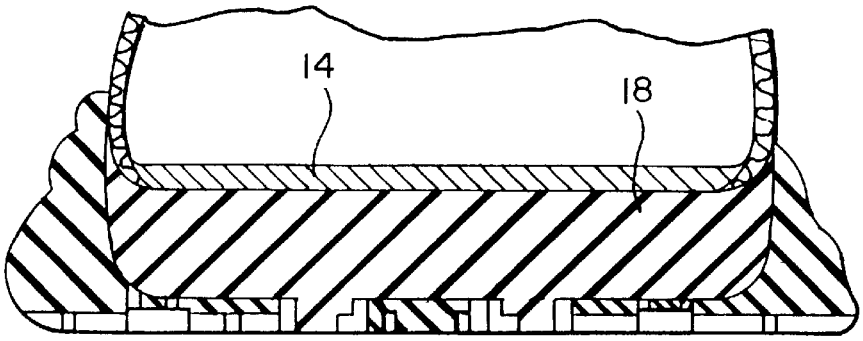

FLEX SOLE

RELATED APPLICATIONS

The present application is a continuation-in-part (CIP) and claims the priority of copending U.S. application Ser. No. 09/347,051 filed Jul. 2, 1999, now U.S. Pat. No. 6,408,544 entitled "FLEX SOLE", which is incorporated by reference herein. The invention is also related to copending U.S. application Ser. No. 09/373,122 filed Aug. 12, 1999, entitled "FLEX SOLE", which is also incorporated by reference herein.

FIELD OF THE INVENTION

The invention relates to footwear or shoes, particularly walking or athletic shoes.

BACKGROUND OF THE INVENTION

Footwear can be designed to provide a variety: of stylistic and functional benefits. A particular functional benefit is the comfort of the wearer of the shoe. Particularly when walking or running, the flexibility and shock absorption of the shoe determine the amount of comfortable support provided to the feet of the shoe wearer.

Shoes normally worn for active use, e.g., extensive walking or fitness sports, typically consist of an upper (of canvas, leather or other supple fabric material) joined to an outer sole (of rubber, leather or other durable material) having a bottom that contacts the ground. The inner surface of the outer sole, i.e., outsole, has distinct regions that contact corresponding portions of the wearer's foot sole. For example, the outsole can have distinct heel, arch and plantar regions that underlie the respective portions of the foot. These regions of the outsole can be specifically adapted to provide functional benefits to the parts of the foot that are supported by them. A highly flexible inner sole, i.e., insole, is usually provided that directly contacts the wearer's foot and is positioned between the foot and the upper surface of the outsole. The insole has an upper surface of fabric or soft leather to give added comfort and breathability to the sole of the foot. The outsole needs to embody both flexible and durable characteristics, to resist wear from pavement and torsional stresses, also to cushion shock from impact due to foot motion.

Others in the art have sought to provided added shock absorption to the outsole by providing added layers or members in various regions of the outsole. For example, U.S. Pat. No. 4,783,910 to Boys, II et al., provides a midsole with a discrete heel capsule to cushion G-forces, in conjunction with an anti-torsion heel member. U.S. Pat. No. 1,994,681 to Bliinifeld, U.S. Pat. No. 4,245,406 to Landay, et al., and U.S. Pat. No. 5,839,208 to Huang disclose outsoles having inner cavities presenting patterns of ribbed structures that are joined to the sides of the outsole. Such structures are said to enhance the shock-absorbing support function of the outsole and its torsional stability.

U.S. Pat. No. 4,794,707 to Franklin, et al., shows a midsole with an internal dynamic rocker element disposed in the forefoot of the midsole, said to enhance walking comfort.

U.S. Pat. No. 4,663,865 to Telecemian has a first set of ribs that extend from within the heel cavity and a second set of ribs extending diagonally through the arch cavity, both sets dovetailing into the floor of the plantar cavity. A resilient cushion is located in the plantar cavity, being shaped and sized corresponding to that cavity. However, the separate cushion does not form an integral part of the inner-plantar cavity of the outsole, but rather functions as an integral component of the midsole than of the outsole. Moreover, such a cushion requires additional steps to assemble together with the midsole during the manufacturing process.

Therefore it is desirable to provide a strategically positioned cushioning support member in a strategic functional region of the outsole activity, which member functions integrally with the outsole in cushioning shock to a given area of the foot of the shoe wearer.

It is further desirable to-provide a cushioning member that is fabricated as part of the inner cavity of the outsole, so that the member is joined thereto and functions integrally with the outsole, versus other components of the shoe during wear.

It is still further desirable to provide an integral cushioning member that functions together with other stabilizing members found within the inner cavity of the outsole.

SUMMARY OF THE INVENTION

The invention advantageously provides enhanced support of the foot wearing a shoe according to the invention, while eliminating unnecessary manufacturing steps. An upper sole, an insole, and an outsole are provided, to manufacture a shoe according to the invention. The outsole comprises a heel, an arch, and a plantar region. A cavity is formed in one or more of the heel, arch and plantar regions of the outsole. A cushioning pad is permanently affixed in the cavity. The upper sole, insole and outsole are then assembled to make the shoe according to the invention. The pad functions integrally with the outsole in cushioning shock to a given area of the foot wearing the shoe. A midsole and the manufacturing process for making the same are no longer needed as a result.

In a preferred embodiment of the invention, the outsole is made of a flexible polymeric material having a given density and the pad is molded in place within the plantar region, the pad being formed of a different polymeric material than the outsole, such that the plantar and heel regions are of differing densities, respectively.

In other embodiments of the invention, injection molding is used to mold the insole and the outsole (with the cushioning pad attached) into a bonded insole/outsole in a single molding step. Alternatively, injection molding is used to mold the upper sole, the insole, and the outsole in a single molding step, depending on manufacturing requirements. A further advantage of the invention is the flexibility of selecting a molding process suitable for the particular manufacturing situation.

In a further embodiment of the invention, the cavity is defined by a plurality of ribs (made of, e.g., thermal plastic rubber or TPR) integrally formed on the peripheral wall of the outsole. The cushioning pad (made of, e.g., ethyl vinyl acetate or EVA) is placed in the cavity as defined by the ribs. The peripheral wall and bottom of the outsole are molded in a first stage. The cushioning pad is made separately. The ribs are then molded in a second stage. The cushioning pad is permanently affixed by adhesion to the top surface of the bottom of the outsole in the cavity and to the surrounding ribs after the ribs are molded. In an alternative embodiment of the invention, the ribs are molded while the cushioning pad is in place in the cavity of the outsole.

In yet another preferred embodiment of the invention, a plurality of ribs form a structure defining a series of combs that articulate with the peripheral wall of the outsole, the arrangement further delimiting an inner periphery of the cavity, wherein the pad is joined to that inner periphery. In a further preferred embodiment, the cavity and pad are shaped to correspond to the contours of the peripheral walls of the outsole.

In an additional embodiment of the invention, a plurality of ribs form a structure defining a series of open combs that extends transversely across the outsole and articulates with the peripheral wall of the outsole within one or more of the heel, arch and plantar regions. It is further preferred that the pad be molded in place within the combs of the plantar region.

An advantage of the invention is that a strategically positioned cushioning support pad can function in a strategic region of the outsole, as an integral part of the outsole, in cushioning shock to a given area of the foot wearing a shoe according to the invention.

Another advantage of the invention is that the cushioning pad can be fabricated as part of the cavity of the outsole, so that the pad is joined thereto and functions integrally with the outsole, versus other components of the shoe during wear.

Yet another advantage of the invention is an integral cushioning pad that functions together with other stabilizing members (e.g., ribs) found within the cavity of the outsole.

A further advantage of the invention is enhanced support and shock absorption by providing an outsole with selected cushioning capacity where needed, without the necessity of a separately engineered midsole.

BRIEF DESCRIPTION OF THE DRAWINGS

These and other features, aspects, and advantages of the invention will become readily apparent with reference to the following detailed description of a presently preferred, but nonetheless illustrative embodiment when read in conjunction with the accompanying drawings, in which like reference designations represent like features throughout the enumerated Figures. The drawings referred to herein will be understood as not being drawn to scale except if specifically noted, the emphasis instead being placed upon illustrating the principles of the invention. In the accompanying drawings:

FIG. 11 is a perspective view of a shoe showing an alternative construction of the pad of the invention located in the plantar region of the outsole;

FIG. 12 is a cross sectional view taken substantially along line 12—12 of FIG. 11.

DETAILED DESCRIPTION OF THE PREFERRED EMBODIMENTS

Figure 1:
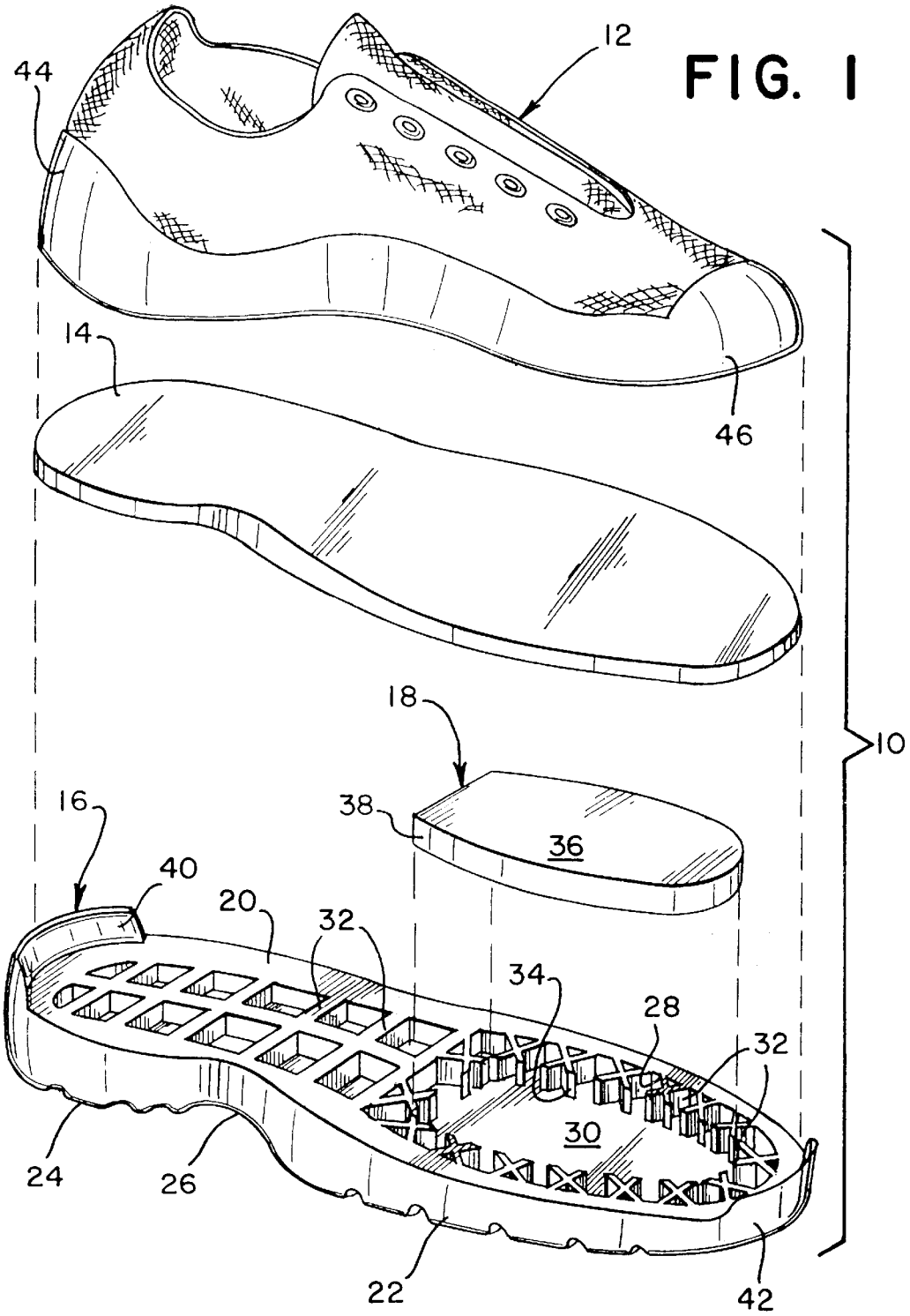
FIG. 1 is an exploded perspective view of the invention in a preferred sports shoe, including an upper, a fabric insole and an outsole with a plantar pad, shown prior to assembly.

According to the invention, elements of a preferred form of footwear are generally shown by shoe 10, in FIGS. 1–3 and 11–14. More specifically and for purposes of illustration, FIGS. 1–3 and 11–14 generally show one or more elements of only a representative shoe 10, while a corresponding shoe of the pair of footwear is not shown. Shoe 10 comprises of an upper 12, an insole 14, an outsole 16 and a pad 18 having a structure and function that shall be detailed below. Those skilled in the art will further appreciate that the invention could take the form of the sports shoe 10 depicted or, alternatively, the footwear could be a walking shoe, hiking boot or other footwear for active use. Similarly, the materials used for the various elements could be leather or other synthetic materials.

Figure 2:
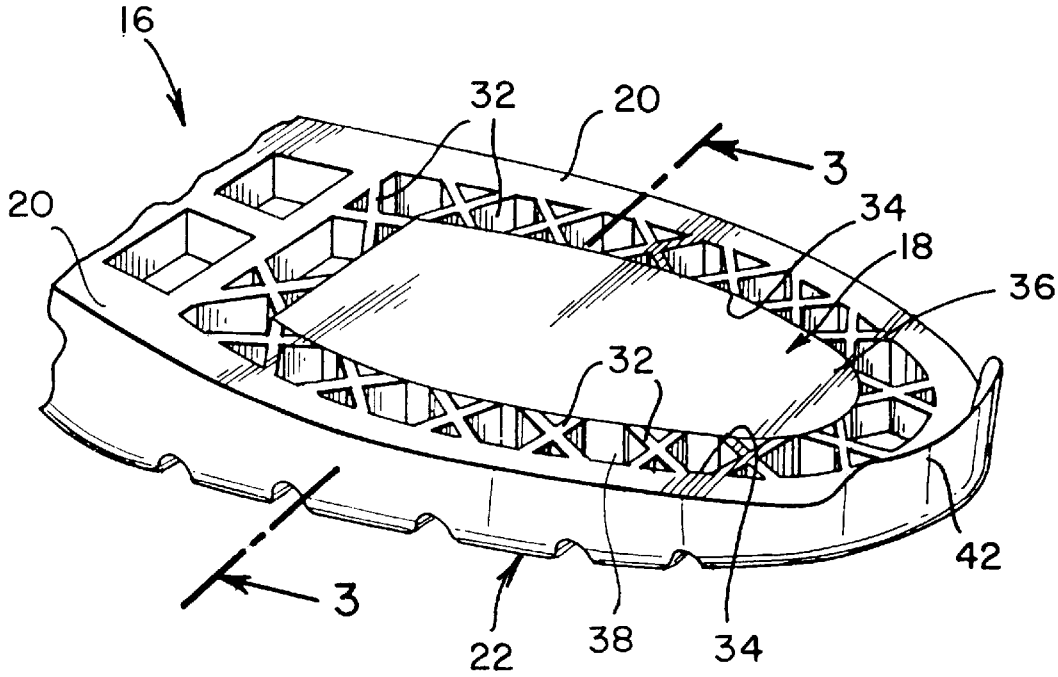
FIG. 2 is a partial perspective view of the internal plantar region of the outsole of FIG. 1, showing the cushioning pad formed on to the floor of the plantar cavity.
Figure 3:
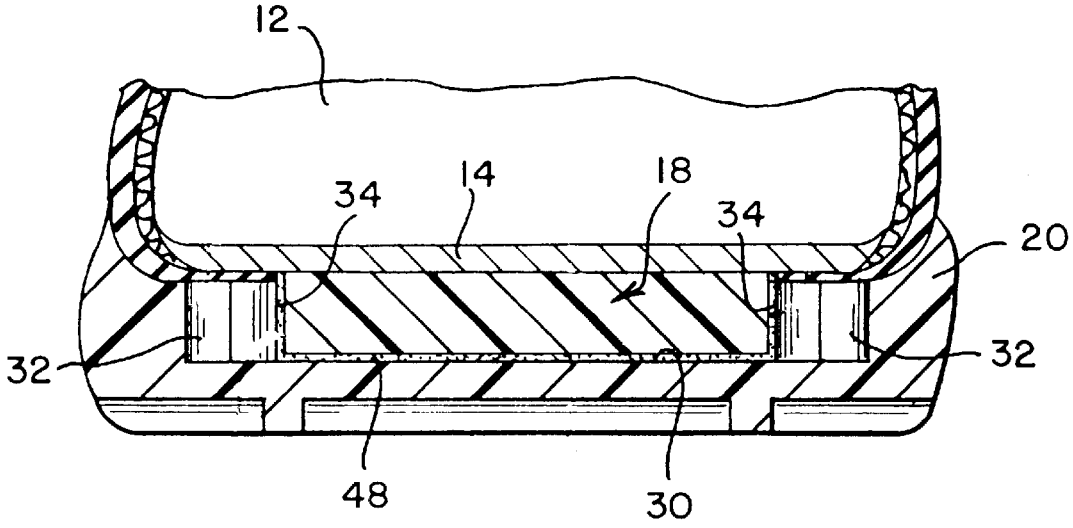
FIG. 3 is a cross section taken at lines 3—3 of FIG. 2.

Further according to the invention, the outsole 16 of the shoe 10 has a peripheral wall 20 delimiting a plantar 22, a heel 24 and an arch 26 region of the outsole. As shown in FIGS. 1–3, an inner cavity 28 is preferably formed in at least one of the plantar 22, heel 24 and arch 26 regions, the cavity having a floor 30. In the embodiment of the invention shown in FIGS. 1–3, cavity 28 is located in the plantar region 22. Pad 48 is a separate cushioning element preferably located within the plantar cavity 28 and bonded to floor 30, where the pad 18 is formed as an integral functional part of the<outsole 26.

Figure 4:
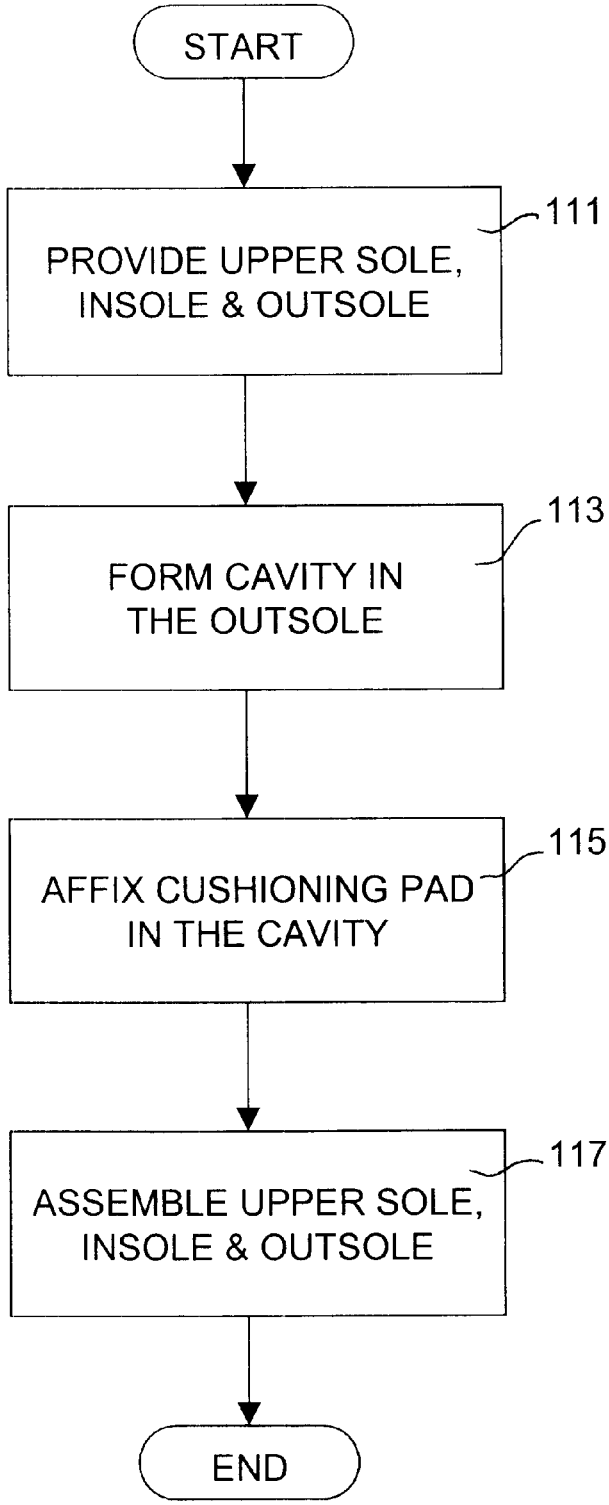
FIG. 4 is a flow diagram illustrating the general methodology of the invention.

FIG. 4 is a flow diagram illustrating the general methodology in manufacturing a shoe according to the invention. FIGS. 1–3 are also referred to herein in describing the general method of the invention. Referring to FIG. 4, an upper 12, an insole 14, and an outsole 16 are provided in step 111. The outsole 16 comprises a heel 24, an arch 26, and a plantar region 22. A cavity 28 is formed in the outsole 16 in step 113. A cushioning pad 18 is permanently affixed in the cavity 28 in step 115, thereafter serving as an integral, functional part of the outsole 26. The cavity 28 can be located anywhere in the outsole 16 where cushioning support is needed, e.g., the heel 24, the arch 26, or the plantar region 22. This provides an advantage and particular flexibility for selecting cushioning capacity where needed, without requiring a separately engineered midsole. The upper 12, the insole 14, and the outsole 16 (with the affixed pad 18) are then assembled to form a shoe according to the invention (step 117).

Figure 5:
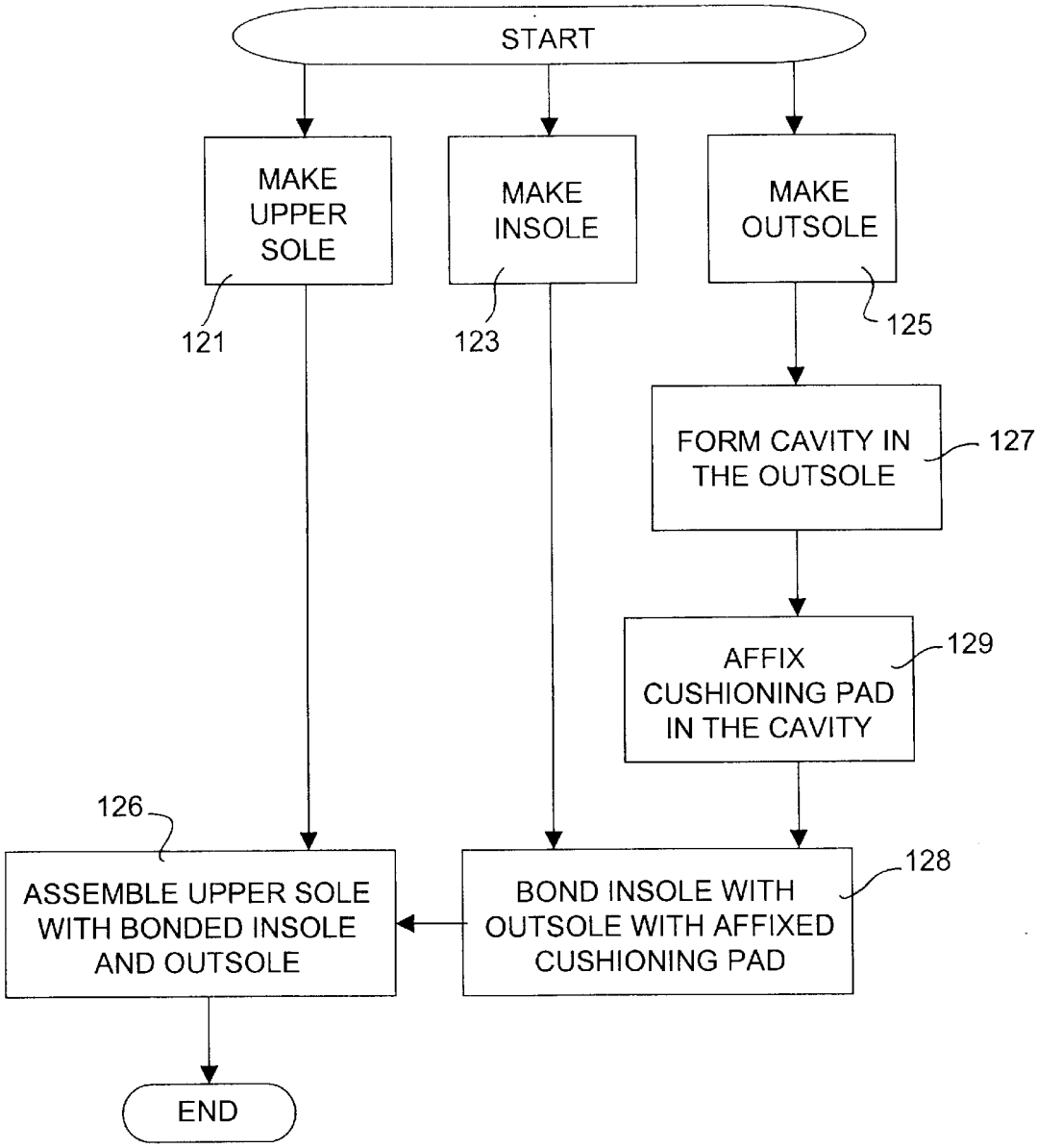
FIGS. 5 and 8 are flow diagrams illustrating different embodiments of the method for making a shoe according to the invention.
Figure 6:
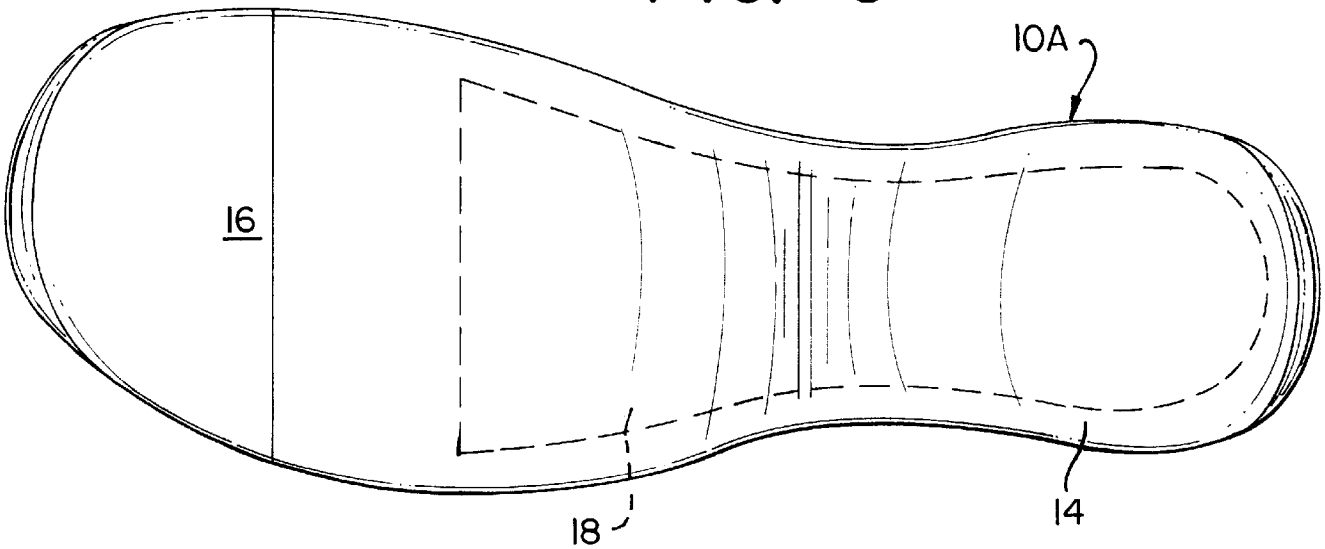
FIGS. 6–7 are diagrams illustrating embodiments of the bonded insole/outsole with a cushioning pad according to the invention.
Figure 7:
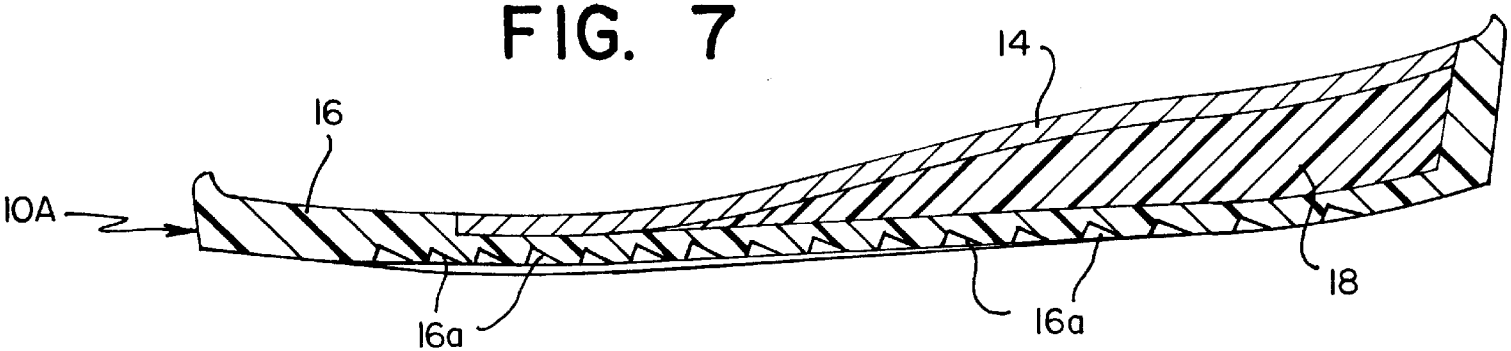

For optimal manufacturing efficiency, the upper 12 the insole 14, and the outsole 16 are made separately and assembled later to form the shoe 110. FIG. 5 is a flow diagram that illustrates such an embodiment of the method of the invention. Elements of a shoe according to the invention (as shown in FIGS. 1–3) are also referred to herein in describing this embodiment of the method of the invention. Referring to FIG. 5, the upper 12, the insole 14, and the outsole 16 are made on an individual basis (steps 121, 123 and 125, respectively). The cavity 28 is formed in the outsole 16 in step 127. The cushioning pad 18 is permanently affixed in the cavity 28, serving as an integral, functional part of the outsole 16 in step 129. After the cushioning pad 18 is affixed in the cavity 28 of the outsole 16, it is bonded with the insole 14 (step 128). The bonded insole 14 and outsole 16 (with affixed pad 18) are then assembled with the upper 12 to form the shoe 10 according to the invention (step 126). The bonded insole 14 and outsole 16 with pad 18 are shown in FIGS. 6–7 (bottom view and side view thereof, respectively), collectively known as bonded insole/outsole 10A. The base of bonded insole/outsole 10A has molded-in grip formations 16*a*, which is known in the art. One advantage of this embodiment of the method of making the shoe 10 according to the invention is that a component, e.g., upper 12, of the shoe 10 can be made separately without waiting for other components (e.g., insole 14, the outsole 16 or bonded insole/outsole 10A) to be manufactured. In particular, components of the shoe 10 can be efficiently made without waiting for the completion of the affixing of the pad 18 to the cavity 28 of the outsole 16. This embodiment of the method of manufacturing the shoe 10 according to the invention is particularly suitable when the upper 12 is pre-fabricated or separately made by an outside manufacturer, e.g., an original equipment manufacturer (OEM).

Figure 8:
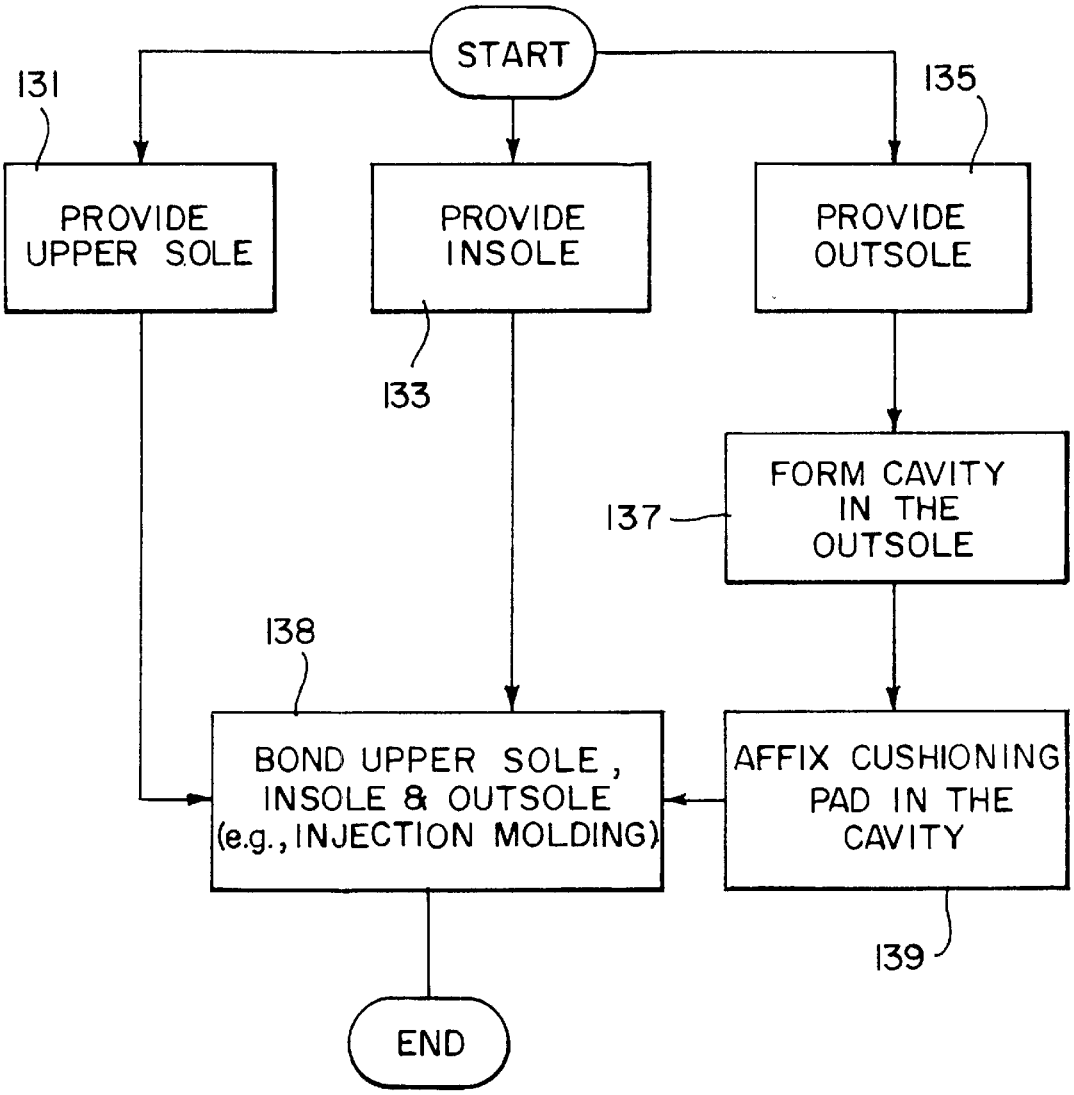

In the alternative, the upper sole 12, the insole 14, and the outsole 16 can be molded in a single step if simultaneous or pseudo-simultaneous manufacturing is desired, depending on manufacturing considerations or factory conditions. FIG. 8 is a flow diagram that illustrates another embodiment of the method for making the shoe 10 according to the invention. Elements of a shoe according to the invention (as shown in FIGS. 1–3) are also referred to herein in describing this embodiment of the method of the invention. Referring to FIG. 8, the upper 12, the insole 14, and the outsole 16 are separately provided in steps 131, 133, and 135, respectively. The cavity 28 is formed in the outsole 16 in step 137. The cushioning pad 18 is permanently affixed in the cavity 28 in step 139. After the pad 18 is affixed in the cavity 28, the upper 12, the insole 14, and the outside 16 (with the affixed pad 18) are bonded together, in a simultaneous or pseudo-simultaneous fashion, to form the shoe 10 according to the invention using, e.g., injection molding which is commonly known in the art (step 138). This particular embodiment of the method of the invention is useful when, e.g., it is more cost-efficient to manufacture the upper 12, the insole 14, and the outsole 16 at a single factory location.

Figure 9:
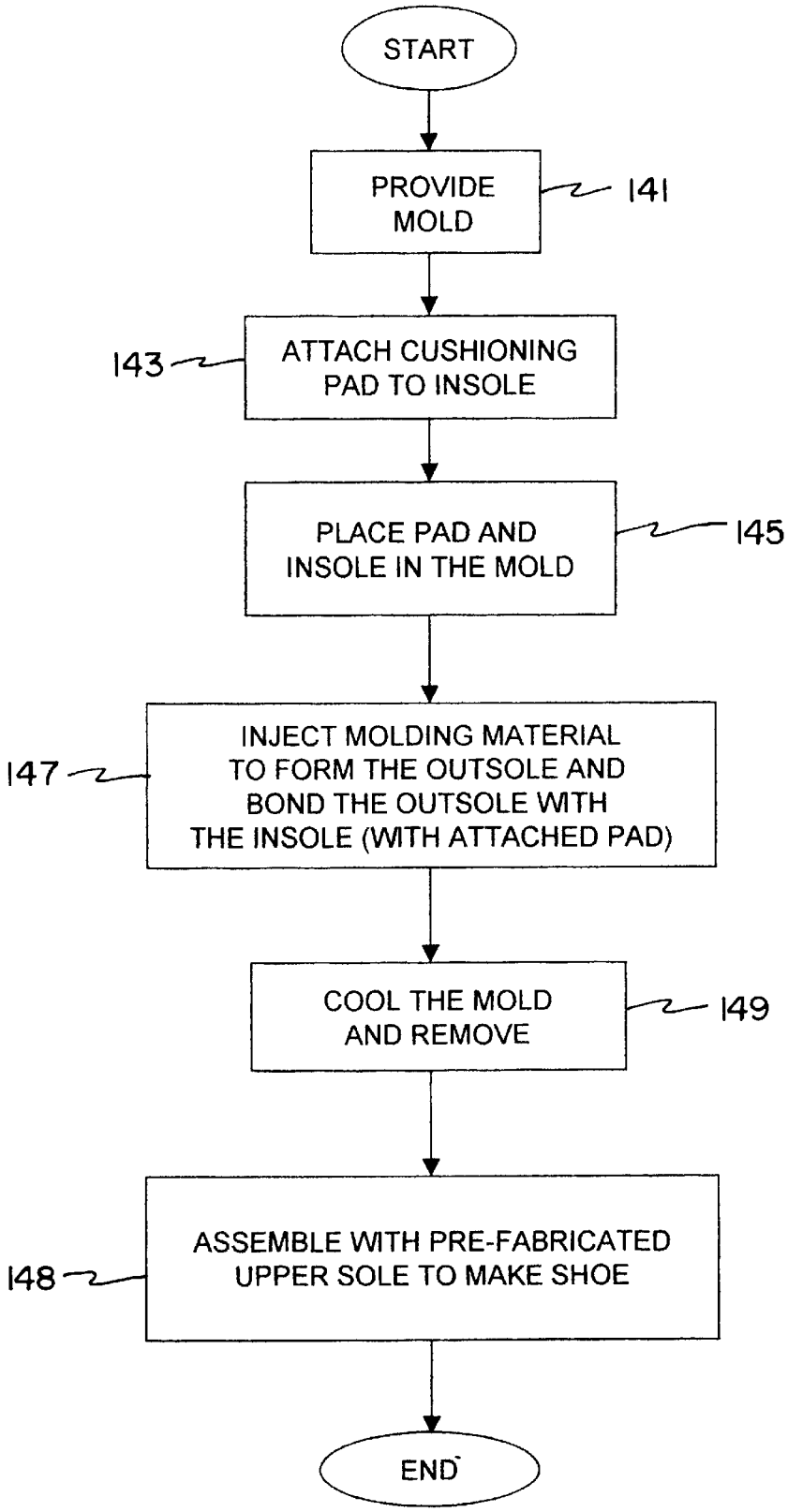
FIGS. 9–10 are flow diagrams illustrating different embodiments of the molding process in making a shoe according to the invention.

FIG. 9 is a flow diagram illustrating an embodiment of the molding process in making a shoe according to the invention. The embodied molding process of FIG. 9 is suitable for making a bonded insole/outsole 10A (as shown in FIGS. 6–7) in an OEM production arrangement. Elements of a shoe according to the invention (as shown in FIGS. 1–3) are also referred to herein in describing this embodiment of the molding process of the invention. Referring to FIG. 9, a mold suitable for molding an insole 14 and outsole 16 into a bonded insole/outsole 10A is provided in step 141. A cushioning pad 18 is attached (by adhesion, stitching or other means) to the insole 14 in step 143. The pad 18 (with attached insole 14) are placed in the mold for injection molding (step 145). After closing the mold, the molding internal for the outsole 16 is heated and then injected into the mold to form the outsole 16 and bond it with the insole 14 with the cushioning pad attached (step 147). That is, the insole 14 and the outsole 16 are molded in a single step. The mold is allowed to cool and the bonded insole/outsole 10A is removed in step 149, which is assembled with a pre-fabricated sole (e.g., provided by an OEM) to make the sole according to the invention.

Figure 10:
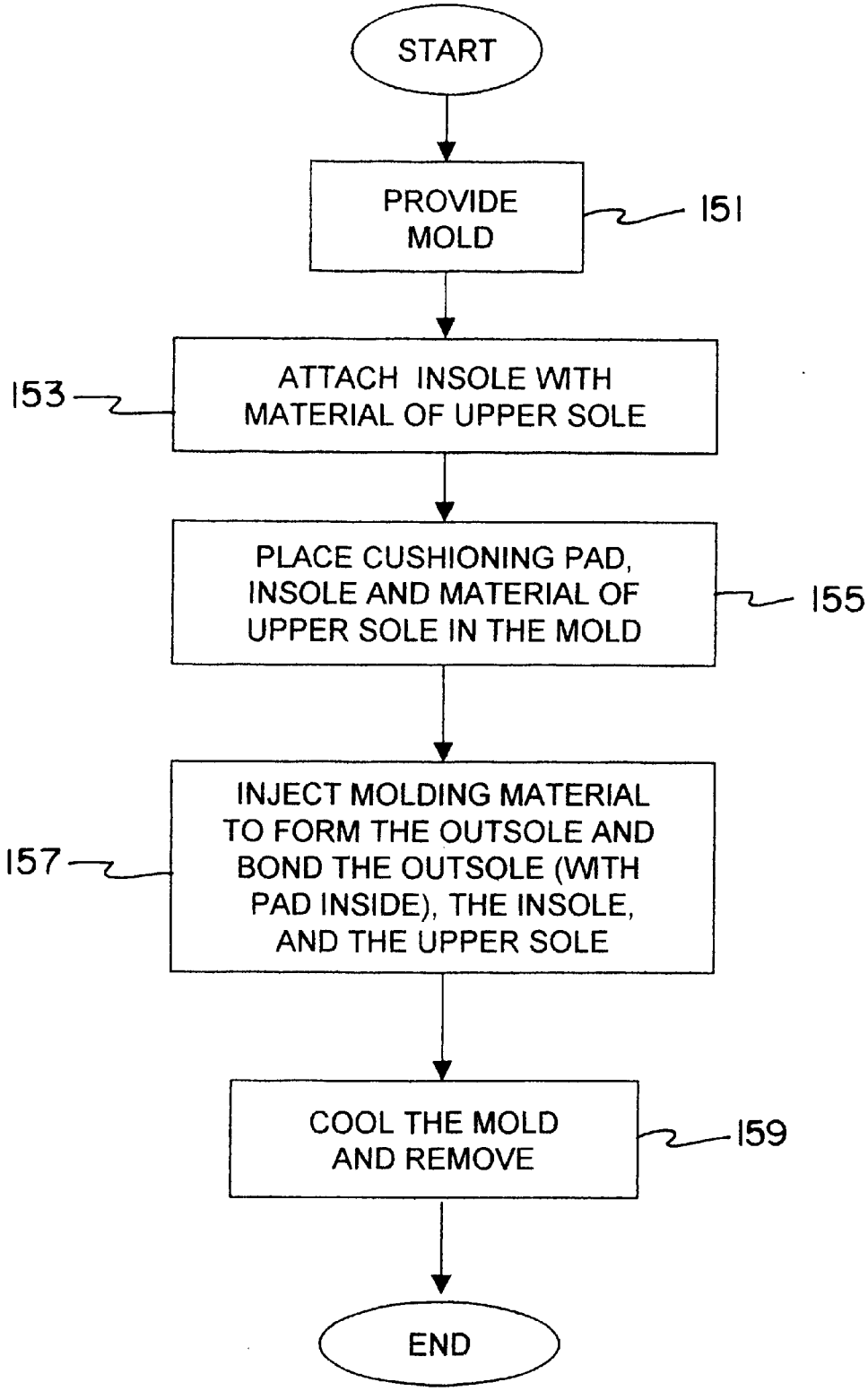

FIG. 10 is a flow diagram illustrating another embodiment of the molding process in making a shoe according to the invention. The embodied molding process of FIG. 10 is suitable for molding the upper 12, the insole 14, and the outsole 16 in a single step. Elements of a shoe according to the invention (as shown in FIGS. 1–3) are also referred to herein in describing this embodiment of the molding process of the invention. Referring to FIG. 10, a mold suitable for molding the insole 14, the upper 12, and the outsole 16 is provided in step 151. The insole 14 is attached with the material for the upper 12 by, e.g., adhesion or stitching, etc. (step 153). The cushioning pad 18, the material for the upper 12 (with the insole 14 attached) are placed in the mold for injection molding (step 155). After closing the mold, the molding material for the outsole 16 is heated and then injected into the mold, so that the outsole 16 is formed encapsulating the pad 18 and securely bonded with the insole 14 and the upper 12 (step 157). The mold is allowed to cool and the finished shoe is removed in step 159. The outsole 16 is formed, molded and bonded to the insole 14 and the upper 12, as described herein, in a single molding step.

The molding apparatus suitable for the molding used in the various embodiments of the invention may be of any suitable type. Particularly preferred is injection molding which utilizes any suitably known injection molding apparatus, the construction and operation thereof are well known in the art. Alternative molding techniques may also be employed, depending on the nature of the molding material used.

In another embodiment of the invention, the cavity 28 is defined by a plurality of ribs 32 integrally formed on the peripheral wall 20 of the outsole. The cushioning pad 18 is placed in the cavity 28 which is defined by the ribs 32. The peripheral wall 20 and bottom of the outsole are molded in a first stage. The pad 18 is made separately. The ribs 32 arc molded in a second stage. The pad 18 is permanently affixed by adhesion to the floor 30 in the cavity 28 and to the surrounding ribs after the ribs 32 are molded. The outsole 16 (with the affixed pad 18) are then bonded with the upper sole 12 and insole 14 to form the shoe 10 according to the invention.

In another embodiment of the invention, the cavity 28 is defined by a plurality of ribs 32 integrally formed on the peripheral wall 20 of the outsole. The cushioning pad 18 is placed in the cavity 28 which is defined by the ribs 32. The peripheral wall 20 and bottom of the outsole are molded in a first stage. The pad 18 is made separately. The ribs 32 are molded in a second stage. The pad 18 is permanently affixed by adhesion to the floor 30 in the cavity 28 and to the surrounding ribs after the ribs 32 are molded. The outsole 16 (with the affixed pad 18) are then bonded with the upper 12 and insole 14 to form the shoe 10 according to the invention.

The inner periphery of cavity 28 and pad 18 are sized and shaped to correspond to one another, and to the contours of the peripheral wall 20 of outsole 16. Pad 18 is typically made of EVA, although other resilient, flexible materials are possible as noted above. Pad 18 has an upper surface 36 that is juxtaposed with the insole 14 and an edge 38 that is positioned adjacent the periphery 34 of cavity 28 during assembly of shoe 10. Heel 40 and toe 42 caps are provided to receive a corresponding heel 44 and toe 46 of the upper 12, respectively, for facilitating the adhesive bonding of these structures together. Prior to assembly of the upper 12 and outsole 16, as mentioned above, the pad 18 can be molded in place onto the floor 30 as follows. A preformed pad 18 is placed in cavity 28 then a layer 48 is applied of a conventional TPR material or one of the preferred materials mentioned above that adhesively bonds to the top 36 and edge 38 surfaces of the pad, acting further to mold these surfaces to the floor 30 and ribs 32 that comprise inner periphery 34 or cavity 28. The pad 18 can also be molded by conventional injection molding, in a relatively simultaneous step along with the outsole 16.

Figure 13:
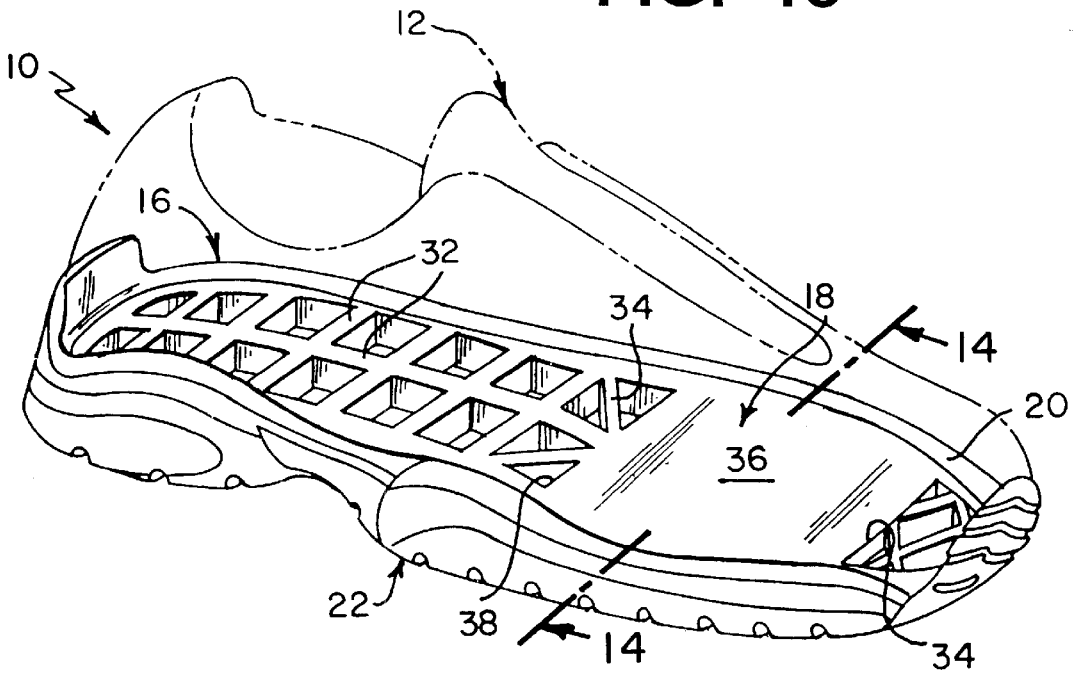
FIG. 13 is a perspective view of a shoe showing another, alternative construction of the pad of the invention located in the plantar region of the outsole.
Figure 14:
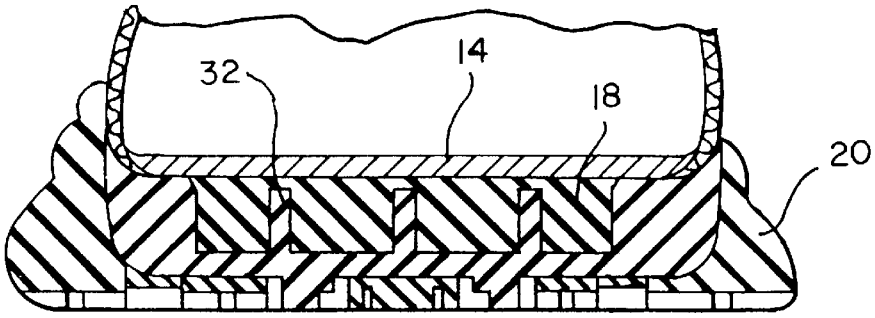
FIG. 14 is a cross sectional view taken substantially along line 14—14 of FIG. 13.

Referring to FIGS. 12–13, pad 18 extends between peripheral wails 20 and fills cavity 28, whereas FIGS. 13–14 alternatively show ribs 32 being present in plantar region 22 such that the polymeric material of injection molded pad 18 is found within the comb structure between ribs 32. Because the polymeric material of ribs 32 and outsole 16 can be the same or different than pad 18, it is possible to have different regions of outsole 16 with differing densities.

Although the invention has been particularly shown and described in detail with reference to the preferred embodiments thereof, the embodiments are not intended to be exhaustive or to limit the invention to the precise forms disclosed herein. It will be understood by those skilled in the art that many modifications in form and detail may be made therein without departing form the spirit and scope of the invention. Similarly, any process steps described herein may be interchangeable with other steps in order to achieve the same result. All such modifications are intended to be encompassed within the scope of the invention, which is defined by the following claims and their equivalents.

I claim:

1. A shoe, comprising:

an upper;

an insole bonded to the upper;

a rubber outsole having a particular density and forming a cavity, said outsole being bonded to the insole to form a bonded insole/outsole wherein the insole and the outsole are bonded in a single outsole injection molding step;

a cushioning pad made of ethyl vinyl acetate (EVA) with a different density than that of the outsole, said pad being permanently affixed in, and functioning as an integral part of the outsole; and a plurality of ribs integrally formed on a peripheral wall of the outsole wherein the ribs surround the pad affixed to the cavity.

2. The shoe of claim 1, wherein the outsole is made of thermal plastic rubber (TPR).

3. The shoe of claim 1, wherein the pad is made of one of the group consisting of ethyl vinyl acetate (EVA) and thermal plastic urethane (TPU).

4. The shoe of claim 1, the outsole further comprising a heel, an arch, and a plantar region, wherein the cavity is formed in one of the group consisting of the heel, the arch, and the plantar region of the outsole.

5. A shoe of claim 1, wherein the upper, the insole and the outsole are bonded in a single injection molding step.

6. The shoe of claim 1, wherein said pad is formed by injection molding in a relatively simultaneous step with said outsole injection molding step.

* * * * *